US005582965A

United States Patent [19]

Deaton et al.

[11] Patent Number: 5,582,965

[45] **Date of Patent: *Dec. 10, 1996**

[54] ULTRATHIN TABULAR GRAIN EMULSIONS WITH SENSITIZATION ENHANCEMENTS (II)

[75] Inventors: Joseph C. Deaton; Richard L. Daubendiek, both of Rochester; Donald L. Black, Webster; Timothy R. Gersey; Joseph G. Lighthouse, both of Rochester; Myra T. Olm, Webster; Xin Wen; Robert D. Wilson, both of Rochester, all of N.Y.

[73] Assignee: Eastman Kodak Company, Rochester, N.Y.

[ * ] Notice: The term of this patent shall not extend beyond the expiration date of Pat. No. 5,503,971.

[21] Appl. No.: 451,881

[22] Filed: May 26, 1995

Related U.S. Application Data

[63] Continuation-in-part of Ser. No. 297,195, Aug. 26, 1994.

[51] Int. Cl.[6] ..... G03C 1/035; G03C 1/005

[52] U.S. Cl. ..... 430/567; 430/569; 430/570

[58] Field of Search ..... 430/567, 569, 430/570

[56] References Cited

U.S. PATENT DOCUMENTS

| | | | |
|---|---|---|---|
| 4,435,501 | 3/1984 | Maskasky | 430/434 |
| 4,439,520 | 3/1984 | Kofron et al. | 430/434 |
| 4,471,050 | 9/1984 | Maskasky | 430/567 |
| 4,814,264 | 3/1989 | Kishida et al. | 430/567 |
| 5,250,403 | 10/1993 | Antoniades et al. | 430/505 |

FOREIGN PATENT DOCUMENTS

| | | | |
|---|---|---|---|
| 0498302A1 | 8/1992 | European Pat. Off. | G03C 1/035 |
| 0507702A1 | 10/1992 | European Pat. Off. | G03C 1/46 |

OTHER PUBLICATIONS

Buhr et al *Research Disclosure,* vol. 253, Item 25330, May 1985.

*Primary Examiner*—Mark F. Huff
*Attorney, Agent, or Firm*—Carl O. Thomas

[57] ABSTRACT

A chemically and spectrally sensitized ultrathin tabular grain emulsion is disclosed including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, and (e) exhibiting an average thickness of less than 0.07 μm.

It has been observed that faster rates of development, relatively thinner tabular grains under comparable conditions of preparation, increased contrast and improvements in speed-granularity relationships can be realized when (1) the tabular grains contain less than 10 mole percent iodide and (2) the surface chemical sensitization sites include epitaxially deposited silver halide protrusions of a face centered cubic crystal lattice structure of the rock salt type forming epitaxial junctions with the tabular grains, the protrusions (a) being restricted to those portions of the tabular grains located nearest peripheral edges of and accounting for less than 50 percent of the {111} major faces of the tabular grains, (b) containing a silver chloride concentration at least 10 mole percent higher than that of the tabular grains, and (c) including a higher iodide concentration than those portions of the tabular grains extending between the {111} major faces and forming epitaxial junctions with the protrusions.

A photographic element is disclosed in which an ultrathin tabular grain emulsion as described above is coated over an emulsion layer intended to record visible light.

14 Claims, No Drawings

ULTRATHIN TABULAR GRAIN EMULSIONS WITH SENSITIZATION ENHANCEMENTS (II)

This is a continuation-in-part of U.S. Ser. No. 297,195, filed Aug. 26, 1994.

FIELD OF THE INVENTION

The invention relates to silver halide photography. More specifically, the invention relates to improved spectrally sensitized silver halide emulsions and to multilayer photographic elements incorporating one or more of these emulsions.

BACKGROUND

Kofron et al U.S. Pat. No. 4,439,520 ushered in the current era of high performance silver halide photography. Kofron et al disclosed and demonstrated striking photographic advantages for chemically and spectrally sensitized tabular grain emulsions in which tabular grains having a diameter of at least 0.6 μm and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional sensitizations, such as reduction sensitization were also disclosed.

In 1982 the first indirect radiographic and color photographic films incorporating the teachings of Kofron et al were introduced commercially. Now, 12 years later, there are clearly understood tabular grain emulsion preferences that are different, depending on the type of product being considered. Indirect radiography has found exceptionally thin tabular grain emulsions to be unattractive, since they produce silver images that have an objectionably warm (i.e., brownish black) image tone. In camera speed color photographic films exceptionally thin tabular grain emulsions usually have been found attractive, particularly when spectrally sensitized to wavelength regions in which native grain sensitivity is low—e.g., at wavelengths longer than about 430 nm. Comparable performance of exceptionally thin tabular grain emulsions containing one or more spectral sensitizing dyes having an absorption peak of less than 430 nm is theoretically possible. However, the art has usually relied on the native blue sensitivity of camera speed emulsions to boost their sensitivity, and this has retarded the transition to exceptionally thin tabular grain emulsions for producing blue exposure records. Grain volume reductions that result from reducing the thickness of tabular grains work against the use of the native blue sensitivity to provide increases in blue speed significantly greater than realized by employing blue absorbing spectral sensitizing dyes. Hence, thicker tabular grains or nontabular grains are a common choice for the blue recording emulsion layers of camera speed film.

Recently, Antoniades et al U.S. Pat. No. 5,250,403 disclosed tabular grain emulsions that represent what were, prior to the present invention, in many ways the best available emulsions for recording exposures in color photographic elements, particularly in the minus blue (red and/or green) portion of the spectrum. Antoniades et al disclosed tabular grain emulsions in which tabular grains having {111} major faces account for greater than 97 percent of total grain projected area. The tabular grains have an equivalent circular diameter (ECD) of at least 0.7 μm and a mean thickness of less than 0.07 μm. Tabular grain emulsions with mean thicknesses of less than 0.07 μm are herein referred to as "ultrathin" tabular grain emulsions. They are suited for use in color photographic elements, particularly in minus blue recording emulsion layers, because of their efficient utilization of silver, attractive speed-granularity relationships, and high levels of image sharpness, both in the emulsion layer and in underlying emulsion layers.

A characteristic of ultrathin tabular grain emulsions that sets them apart from other tabular grain emulsions is that they do not exhibit reflection maxima within the visible spectrum, as is recognized to be characteristic of tabular grains having thicknesses in the 0.18 to 0.08 μm range, as taught by Buhr et al, *Research Disclosure,* Vol. 253, Item 25330, May 1985. *Research Disclosure* is published by Kenneth Mason Publications, Ltd., Dudley House, 12 North St., Emsworth, Hampshire P010 7DQ, England. In multilayer photographic elements overlying emulsion layers with mean tabular grain thicknesses in the 0.18 to 0.08 μm range require care in selection, since their reflection properties differ widely within the visible spectrum. The choice of ultrathin tabular grain emulsions in building multilayer photographic elements eliminates spectral reflectance dictated choices of different mean grain thicknesses in the various emulsion layers overlying other emulsion layers. Hence, the use of ultrathin tabular grain emulsions not only allows improvements in photographic performance, it also offers the advantage of simplifying the construction of multilayer photographic elements.

An early, cross-referenced variation on the teachings of Kofron et al was provided by Maskasky U.S. Pat. No. 4,435,501, hereinafter referred to as Maskasky I. Maskasky I recognized that a site director, such as iodide ion, an aminoazaindene, or a selected spectral sensitizing dye, adsorbed to the surfaces of host tabular grains was capable of directing silver salt epitaxy to selected sites, typically the edges and/or corners, of the host grains. Depending upon the composition and site of the silver salt epitaxy, significant increases in speed were observed. The most highly controlled site depositions (e.g., corner specific epitaxy siting) and the highest reported photographic speeds reported by Maskasky I were obtained by epitaxially depositing silver chloride onto silver iodobromide tabular grains. Maskasky I did not have available an ultrathin tabular grain emulsion to sensitize by epitaxial deposition, but it is clear that had such emulsion been available the intentional introduction of iodide during epitaxial deposition would not have been undertaken. Maskasky I taught a preference for epitaxially depositing a silver salt having a higher solubility than the host tabular grains, stating that this reduces any tendency toward dissolution of the tabular grains while silver salt is being deposited. It would appear intuitively obvious that ultrathin tabular grains would be more susceptible to dissolution than the much thicker tabular grains that Maskasky I actually employed in its reported investigations. Maskasky I recognized that even when chloride is the sole halide run into a tabular grain emulsion during epitaxial deposition, a minor portion of the halide contained in the host tabular grains can migrate to the silver chloride epitaxy. Maskasky I offers as an example the inclusion of minor amounts of bromide ion when silver and chloride ions are being run into a tabular grain emulsion during epitaxial deposition. From the iodide levels contained in the tabular grain emulsions of Maskasky I and the investigations of this invention, reported in the Examples below, it is apparent that the epitaxial depositions of Maskasky I contained only a fraction of a mole percent iodide transferred from the host tabular grains.

Maskasky U.S. Pat. No. 4,471,050, hereinafter referred to as Maskasky II, discloses that nonisomorphic silver salts can be selectively deposited on the edges of silver halide host grains without relying on a supplemental site director. The nonisomorphic silver salts include silver thiocyanate, β phase silver iodide (which exhibits a hexagonal wurtzite type crystal structure), γ phase silver iodide (which exhibits a zinc blende type crystal structure), silver phosphates (including meta- and pyro-phosphates) and silver carbonate. None of these nonisomorphic silver salts exhibit a face centered cubic crystal structure of the type found in photographic silver halides—i.e., an isomorphic face centered cubic crystal structure of the rock salt type. In fact, speed enhancements produced by nonisomorphic silver salt epitaxy have been much smaller than those obtained by comparable isomorphic silver salt epitaxial sensitizations.

RELATED PATENT APPLICATIONS

Daubendiek et al U.S. Ser. No. 08/359,251, filed Dec. 19, 1994, commonly assigned, titled EPITAXIALLY SENSITIZED ULTRATHIN TABULAR GRAIN EMULSIONS, now U.S. Pat. No. 5,494,789, (Daubendiek et al I) observed photographic performance advantages to be exhibited by ultrathin tabular grain emulsions that have been chemically and spectrally sensitized, wherein chemical sensitization includes an epitaxially deposited silver salt.

Daubendiek et al U.S. Ser. No. 08/297,430, filed Aug. 26, 1994, commonly assigned, titled ULTRATHIN TABULAR GRAIN EMULSIONS CONTAINING SPEED-GRANULARITY ENHANCEMENTS, now U.S. Pat. No. 5,503,971, (Daubendiek et al II) observed in addition to the photographic performance advantages of Daubendiek et al I improvements in speed-granularity relationships attributable to the combination of chemical sensitizations including silver salt epitaxy and iodide distributions in the host tabular grains profiled so that the higher iodide host grain concentrations occur adjacent the corners and edges of the tabular grains and preferentially receive the silver salt epitaxy.

Olm et al U.S. Ser. No. 08/296,562, filed Aug. 26, 1994, commonly assigned, titled ULTRATHIN TABULAR GRAIN EMULSIONS WITH NOVEL DOPANT MANAGEMENT, now U.S. Pat. No. 5,503,970, observed an improvement on the emulsions of U.S. Ser. No. 08/297,195, noted above, and those of Daubendiek et al I and II in which a dopant is incorporated in the silver salt epitaxy.

PROBLEM TO BE SOLVED

Notwithstanding the many advantages of tabular grain emulsions in general and the specific improvements represented by ultrathin tabular grain emulsions and color photographic elements, including those disclosed by Antoniades et al, there has remained an unsatisfied need for performance improvements in ultrathin tabular grain emulsions heretofore unavailable in the art as well as photographic elements containing these emulsions and for alternative choices for constructing emulsions and photographic elements of the highest attainable performance characteristics for color photography.

While the most favorable speed-granularity relationships have been achieved by incorporating significant amounts of iodide in tabular grain emulsions, the presence of iodide slows rates of development and contributes to contrast reductions. Further, higher iodide concentrations result in thicker tabular grains under comparable conditions of grain formation. A challenge that the art has long faced and not solved is how to obtain the advantages of iodide in terms of speed-granularity relationships while minimizing unwanted effects.

In addition there is a need in the art for ultrathin tabular grain emulsions that are "robust", where the term "robust" is employed to indicate the emulsion remains close to aim (i.e., planned) photographic characteristics despite inadvertent manufacturing variances. It is not uncommon to produce photographic emulsions that appear attractive in terms of their photographic properties when produced under laboratory conditions only to find that small, inadvertent variances in manufacturing procedures result in large quantities of emulsions that depart from aim characteristics to such an extent they cannot satisfy commercial requirements. There is in the art a need for high performance tabular grain emulsions that exhibit high levels of robustness or aim inertia, varying little from aim photographic characteristics from one manufacturing run to the next.

SUMMARY OF THE INVENTION

In one aspect this invention is directed to an improved radiation-sensitive emulsion comprised of (1) a dispersing medium, (2) silver halide grains including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and (3) a spectral sensitizing dye adsorbed to the surfaces of the tabular grains, wherein the surface chemical sensitization sites include epitaxially deposited silver halide protrusions of a face centered cubic crystal lattice structure of the rock salt type forming epitaxial junctions with the tabular grains, the protrusions (a) being restricted to those portions of the tabular grains located nearest peripheral edges of and accounting for less than 50 percent of the {111} major faces of the tabular grains, (b) containing a silver chloride concentration at least 10 mole percent higher than that of the tabular grains, and (c) including a higher iodide concentration than those portions of the tabular grains extending between the {111} major faces and forming epitaxial junctions with the protrusions.

In an additional aspect this invention is directed to a photographic element comprised of (1) a support, (2) a first silver halide emulsion layer coated on the support and sensitized to produce a photographic record when exposed to specular light within the visible wavelength region of from 400 to 700 nm, and (3) a second silver halide emulsion layer capable of producing a second photographic record coated over the first silver halide emulsion layer to receive specular visible light intended for the exposure of the first silver halide emulsion layer, the second silver halide emulsion layer being capable of acting as a transmission medium for the delivery of at least a portion of the visible light intended for the exposure of the first silver halide emulsion layer in the form of specular light, wherein the second silver halide emulsion layer is comprised of an improved emulsion according to the invention.

The improved ultrathin tabular grain emulsions of the present invention are the first to employ silver halide epitaxy in their chemical sensitization and the first emulsions of any type to demonstrate a performance advantage attributable to the intentional incorporation of increased iodide concentrations in the silver halide epitaxy. The present invention has been realized by (1) overcoming a bias in the art against applying silver halide epitaxial sensitization to ultrathin tabular grain emulsions, (2) overcoming a bias in the art against intentionally introducing silver iodide in silver halide epitaxy, (3) observing improvements in performance as compared to ultrathin tabular grain emulsions receiving only conventional sulfur and gold sensitizations, and (4) observing larger improvements in sensitivity than expected, based on similar sensitizations of thicker tabular grains.

Conspicuously absent from the teachings of Antoniades et al are demonstrations or suggestions of the suitability of silver halide epitaxial sensitizations of the ultrathin tabular grain emulsions therein disclosed. Antoniades et al was, of course, aware of the teachings of Maskasky I and II, but correctly observed that Maskasky I and II provided no explicit teaching or examples applying silver halide epitaxial sensitizations to ultrathin tabular grain emulsions. Having no original observations to rely upon and finding no explicit teaching of applying silver halide sensitization to ultrathin tabular grain emulsions, Antoniades et al was unwilling to speculate on the possible suitability of such sensitizations to the ultrathin tabular grain emulsions disclosed. The much larger surface to volume ratios exhibited by ultrathin tabular grains as compared to those employed by Maskasky I (Maskasky II contains no tabular grain examples) in itself was enough to raise significant doubt as to whether the ultrathin structure of the tabular grains could be maintained during epitaxial silver halide deposition. Further, it appeared intuitively obvious that the addition of silver halide epitaxy to ultrathin tabular grain emulsions would not improve image sharpness, either in the emulsion layer itself or in an underlying emulsion layer.

It has been discovered that chemical sensitizations including silver halide epitaxy are not only compatible with ultrathin host tabular grains, but that the resulting emulsions show improvements which were wholly unexpected, either in degree or in kind.

Specifically, increases in sensitivity imparted to ultrathin tabular grain emulsions by silver halide epitaxy have been observed to be larger than were expected based on the observations of Maskasky I employing thicker tabular host grains.

Further, it has been observed quite surprisingly that intentionally increasing the iodide concentrations of silver halide epitaxy containing silver chloride further increases speed and contrast and decreases granularity.

The emulsions of this invention differ from those of Daubendiek et al I and II, Olm et al, and parent application Ser. No. 08/297,195 in requiring a higher iodide concentration in the silver halide epitaxy than in those portions of the tabular grains with which it forms an epitaxial junction. This runs exactly contrary to a bias in the art toward maintaining higher levels of iodide in the tabular grains than in associated silver halide epitaxy. It has been discovered that as iodide is increased in the silver halide epitaxy unexpected speed-granularity improvements can be realized. Further, it is possible for the iodide levels in the epitaxy to exceed those of the ultrathin tabular grain hosts. Thus, overall reductions in iodide can be realized that permit more rapid development, higher levels of contrast, and the formation of thinner tabular grains under comparable conditions of preparation attributable to lower iodide concentrations.

Anticipated unacceptable reductions in image sharpness, investigated in terms of specularity measurements, simply did not materialize, even when the quantities of silver halide epitaxy were increased well above the preferred maximum levels taught by Maskasky I and II.

Still another advantage is based on the observation of reduced unwanted wavelength absorption as compared to relatively thicker tabular grain emulsions similarly sensitized. A higher percentage of total light absorption was confined to the spectral region in which the spectral sensitizing dye or dyes exhibited absorption maxima. For minus blue sensitized ultrathin tabular grain emulsions native blue absorption was also reduced.

Finally, the emulsions investigated have demonstrated an unexpected robustness. It has been demonstrated that, when levels of spectral sensitizing dye are varied, as can occur during manufacturing operations, the silver halide epitaxially sensitized ultrathin tabular grain emulsions of the invention exhibit less variance in sensitivity than comparable ultrathin tabular grain emulsions that employ only sulfur and gold sensitizers.

DESCRIPTION OF PREFERRED EMBODIMENTS

The invention is directed to an improvement in spectrally sensitized photographic emulsions. The emulsions are specifically contemplated for incorporation in camera speed color photographic films.

The emulsions of the invention can be realized by chemically and spectrally sensitizing any conventional ultrathin tabular grain emulsion in which the tabular grains (a) have {111} major faces;

(b) contain greater than 70 mole percent bromide and at least 0.25 mole percent iodide, based on silver;

(c) account for greater than 90 percent of total grain projected area;

(d) exhibit an average ECD of at least 0.7 μm; and (e) exhibit an average thickness of less than 0.07 μm.

Although criteria (a) through (e) are too stringent to be satisfied by the vast majority of known tabular grain emulsions, a few published precipitation techniques are capable of producing emulsions satisfying these criteria. Antoniades et al, cited above and here incorporated by reference, demonstrates preferred silver iodobromide emulsions satisfying these criteria. Zola and Bryant published European patent application 0 362 699 A3, also discloses silver iodobromide emulsions satisfying these criteria.

In referring to grains and emulsions containing more than one halide, the halides are named in their order of ascending concentration.

The term "ultrathin" is hereinafter employed to indicate tabular grains having a thickness of less than 0.07 μm.

For camera speed films it is generally preferred that the tabular grains contain at least 0.25 (preferably at least 1.0)

mole percent iodide, based on silver. These low levels of iodide are also contemplated in the ultrathin tabular grains of the emulsions of this invention. However, no iodide in the ultrathin tabular grains is required to realize the speed-granularity advantages of the invention. Iodide incorporation is instead contemplated as a convenience in morphologically stabilizing the ultrathin tabular grains, since ultrathin silver bromide grains are much more prone to suffer morphological degradation (e.g., thickening) during emulsion preparation or post-preparation holding. The ultrathin tabular grains in the emulsions of the invention contain in all instances less than 10 mole percent iodide, preferably less than 6 mole percent iodide, and optimally less than 4 mole percent iodide.

It is possible to include minor amounts of chloride ion in the ultrathin tabular grains. As disclosed by Delton U.S. Pat. Nos. 5,372,927 and 5,470,698, both commonly assigned, ultrathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (°C.) boundaries of Curve A (preferably within the boundaries of Curve B) shown by Delton, corresponding to Curves A and B of Piggin et al U.S. Pat. Nos. 5,061,609 and 5,061,616, the disclosures of which are here incorporated by reference. Under these conditions of precipitation the presence of chloride ion actually contributes to reducing the thickness of the tabular grains. Although it is preferred to employ precipitation conditions under which chloride ion, when present, can contribute to reductions in the tabular grain thickness, it is recognized that chloride ion can be added during any conventional ultrathin tabular grain precipitation to the extent it is compatible with retaining tabular grain mean thicknesses of less than 0.07 μm.

The ultrathin tabular grains accounting for at least 90 percent of total grain projected area contain at least 70 mole percent bromide and at least 0.25 mole percent iodide, based on silver. These ultrathin tabular grains include silver iodobromide, silver iodochlorobromide and silver chloroiodobromide grains. All references to the composition of the ultrathin tabular grains exclude the silver halide epitaxy.

The iodide within the ultrathin tabular grains can be uniformly or non-uniformly distributed within the tabular grains in any conventional manner. The example emulsions of Antoniades et al illustrate relatively uniform iodide distributions. Solberg et al U.S. Pat. No. 4,433,048, the disclosure of which is here incorporated by reference, discloses non-uniform iodide profiles that can reduce granularity without reducing speed. In the ultrathin tabular grains of the emulsions of the present invention it is specifically contemplated that the portions of the ultrathin tabular grains extending between their {111} major faces that form an epitaxial junction with silver halide deposited as a chemical sensitizer contain a lower iodide concentration than the silver halide epitaxy. Thus, it is specifically contemplated that those portions of the tabular grains can exhibit a lower iodide concentration than the average iodide concentration of the ultrathin tabular grains. For example, those portions of the ultrathin tabular grains can be formed by silver bromide, if desired.

The ultrathin tabular grains produced by the teachings of Antoniades et al, Zola and Bryant and Delton all have {111} major faces. Such tabular grains typically have triangular or hexagonal major faces. The tabular structure of the grains is attributed to the inclusion of parallel twin planes.

The tabular grains of the emulsions of the invention account for greater than 90 percent of total grain projected area. Ultrathin tabular grain emulsions in which the tabular grains account for greater than 97 percent of total grain projected area can be produced by the preparation procedures taught by Antoniades et al and are preferred. Antoniades et al reports emulsions in which >99% (substantially all) of total grain projected area is accounted for by tabular grains. Similarly, Delton reports that substantially all of the grains precipitated in forming the ultrathin tabular grain emulsions were tabular. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains accounting for greater than 90 percent of total grain projected area exhibit an average ECD of at least 0.7 μm. The advantage to be realized by maintaining the average ECD of at least 0.7 μm is demonstrated in Tables III and IV of Antoniades et al. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the ultrathin tabular grain emulsions of the invention the tabular grains accounting for greater than 90 percent of total grain projected area exhibit a mean thickness of less than 0.07 μm. At a mean grain thickness of 0.07 μm there is little variance between reflectance in the green and red regions of the spectrum. Additionally, compared to tabular grain emulsions with mean grain thicknesses in the 0.08 to 0.20 μm range, differences between minus blue and blue reflectances are not large. This decoupling of reflectance magnitude from wavelength of exposure in the visible region simplifies film construction in that green and red recording emulsions (and to a lesser degree blue recording emulsions) can be constructed using the same or similar tabular grain emulsions. If the mean thicknesses of the tabular grains are further reduced below 0.07 μm, the average reflectances observed within the visible spectrum are also reduced. Therefore, it is preferred to maintain mean grain thicknesses at less than 0.05 μm. Generally the lowest mean tabular grain thickness conveniently realized by the precipitation process employed is preferred. Thus, ultrathin tabular grain emulsions with mean tabular grain thicknesses in the range of from about 0.03 to 0.05 μm are readily realized. Daubendiek et al U.S. Pat. No. 4,672,027 reports mean tabular grain thicknesses of 0.017 μm. Utilizing the grain growth techniques taught by Antoniades et al these emulsions could be grown to average ECD's of at least 0.7 μm without appreciable thickening—e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20 Å) have been observed in the emulsions of Antoniades et al, Kofron et al suggests a practical minimum tabular grain thickness about 0.01 μm.

Preferred ultrathin tabular grain emulsions are those in which grain to grain variance is held to low levels. Antoniades et al reports ultrathin tabular grain emulsions in which greater than 90 percent of the tabular grains have hexagonal major faces. Antoniades also reports ultrathin tabular grain emulsions exhibiting a coefficient of variation (COV) based on ECD of less than 25 percent and even less than 20 percent.

It is recognized that both photographic sensitivity and granularity increase with increasing mean grain ECD. From comparisons of sensitivities and granularities of optimally sensitized emulsions of differing grain ECD's the art has established that with each doubling in speed (i.e., 0.3 log E increase in speed, where E is exposure in lux-seconds) emulsions exhibiting the same speed-granularity relationship will incur a granularity increase of 7 granularity units.

It has been observed that the presence of even a small percentage of larger ECD grains in the ultrathin tabular grain emulsions of the invention can produce a significant increase in emulsion granularity. Antoniades et al preferred low COV emulsions, since placing restrictions on COV necessarily draws the tabular grain ECD's present closer to the mean.

It is a recognition of this invention that COV is not the best approach for judging emulsion granularity. Requiring low emulsion COV values places restrictions on both the grain populations larger than and smaller than the mean grain ECD, whereas it is only the former grain population that is driving granularity to higher levels. The art's reliance on overall COV measurements has been predicated on the assumption that grain size-frequency distributions, whether widely or narrowly dispersed, are Gaussian error function distributions that are inherent in precipitation procedures and not readily controlled.

It is specifically contemplated to modify the ultrathin tabular grain precipitation procedures taught by Antoniades et al to decrease selectively the size-frequency distribution of the ultrathin tabular grains exhibiting an ECD larger than the mean ECD of the emulsions. Because the size-frequency distribution of grains having ECD's less than the mean is not being correspondingly reduced, the result is that overall COV values are not appreciably reduced. However, the advantageous reductions in emulsion granularity have been clearly established.

It has been discovered that disproportionate size range reductions in the size-frequency distributions of ultrathin tabular grains having greater than mean ECD's (hereinafter referred to as the $>ECD_{av}$. grains) can be realized by modifying the procedure for precipitation of the ultrathin tabular grain emulsions in the following manner: Ultrathin tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent.

Any of the conventional techniques for oxidizing the methionine of a gelatino-peptizer can be employed. Maskasky U.S. Pat. No. 4,713,320 (hereinafter referred to as Maskasky III), here incorporated by reference, teaches to reduce methionine levels by oxidation to less than 30 μmoles, preferably less than 12 μmoles, per gram of gelatin by employing a strong oxidizing agent. In fact, the oxidizing agent treatments that Maskasky III employ reduce methionine below detectable limits. Examples of agents that have been employed for oxidizing the methionine in gelatino-peptizers include NaOCl, chloramine, potassium monopersulfate, hydrogen peroxide and peroxide releasing compounds, and ozone. King et al U.S. Pat. No. 4,942,120, here incorporated by reference, teaches oxidizing the methionine component of gelatino-peptizers with an alkylating agent. Takada et al published European patent application 0 434 012 discloses precipitating in the presence of a thiosulfonate of one of the following formulae:

$$R—SO_2S—M \quad (I)$$

$$R—SO_2S—R^1 \quad (II)$$

$$R—SO_2S—Lm—SSO_2—R^2 \quad (III)$$

where R, $R^1$ and $R^2$ are either the same or different and represent an aliphatic group, an aromatic group, or a heterocyclic group, M represents a cation, L represents a divalent linking group, and m is 0 or 1, wherein R, $R^1$, $R^2$ and L combine to form a ring. Gelatino-peptizers include gelatin—e.g., alkali-treated gelatin (cattle, bone or hide gelatin) or acid-treated gelatin (pigskin gelatin) and gelatin derivatives, e.g., acetylated or phthalated gelatin.

Although not essential to the practice of the invention, improvements in photographic performance compatible with the advantages elsewhere described can be realized by incorporating a dopant in the ultrathin tabular grains. As employed herein the term "dopant" refers to a material other than a silver or halide ion contained within the face centered cubic crystal lattice structure of the silver halide forming the ultrathin tabular grains. Although the introduction of dopants can contribute to the thickening of ultrathin tabular grains during their precipitation when introduced in high concentrations and/or before, during or immediately following grain nucleation, ultrathin tabular grains can be formed with dopants present during grain growth, provided dopant introductions are delayed until after grain nucleation or introduced in prorated amounts early in grain growth and preferably continued into or undertaken entirely during the latter stage of ultrathin tabular grain growth. It has been also recognized from the teachings of Olm et al, cited above, that these same dopants can be introduced with the silver salt to be epitaxially deposited on the ultrathin tabular grains while entirely avoiding any risk of thickening the ultrathin tabular grains.

Any conventional dopant known to be useful in a silver halide face centered cubic crystal lattice structure can be employed. Photographically useful dopants selected from a wide range of periods and groups within the Periodic Table of Elements have been reported. As employed herein, references to periods and groups are based on the Periodic Table of Elements as adopted by the American Chemical Society and published in the *Chemical and Engineering News*, Feb. 4, 1985, p. 26. Conventional dopants include ions from periods 3 to 7 (most commonly 4 to 6) of the Periodic Table of Elements, such as Fe, Co, Ni, Ru, Rh, Pd, Re, Os, Ir, Pt, Mg, Al, Ca, Sc, Ti, V, Cr, Mn, Cu, Zn, Ca, Ge, As, Se, Sr, Y, Mo, Zr, Nb, Cd, In, Sn, Sb, Ba, La, W, Au, Hg, Tl, Pb, Bi, Ce and U. The dopants can be employed (a) to increase the sensitivity, (b) to reduce high or low intensity reciprocity failure, (c) to increase, decrease or reduce the variation of contrast, (d) to reduce pressure sensitivity, (e) to decrease dye desensitization, (f) to increase stability (including reducing thermal instability), (g) to reduce minimum density, and/or (h) to increase maximum density. For some uses any polyvalent metal ion is effective. The following are illustrative of conventional dopants capable of producing one or more of the effects noted above when incorporated in the silver halide epitaxy: B. H. Carroll, "Iridium Sensitization: A Literature Review", *Photographic Science and Engineering*, Vol. 24, No. 6, November/December 1980, pp. 265–267; Hochstetter U.S. Pat. No. 1,951,933; De Witt U.S. Pat. No. 2,628,167; Spence et al U.S. Pat. No. 3,687,676 and Gilman et al U.S. Pat. No. 3,761,267; Ohkubo et al U.S. Pat. No. 3,890,154; Iwaosa et al U.S. Pat. No. 3,901,711; Yamasue et al U.S. Pat. No. 3,901,713; Habu et al U.S. Pat. No. 4,173,483; Atwell U.S. Pat. No. 4,269,927; Weyde U.S. Pat. No. 4,413,055; Menjo et al U.S. Pat. No. 4,477,561; Habu et al U.S. Pat. No. 4,581,327; Kobuta et al U.S. Pat. No. 4,643,965; Yamashita et al U.S. Pat. No. 4,806,462; Grzeskowiak et al U.S. Pat. No. 4,828,962; Janusonis U.S. Pat. No. 4,835,093; Leubner et al U.S. Pat. No. 4,902,611; Inoue et al U.S. Pat. No. 4,981,780; Kim U.S. Pat. No. 4,997,751; Shiba et al U.S. Pat. No. 5,057,402; Maekawa et al U.S. Pat. No. 5,134,060; Kawai et al U.S. Pat. No. 5,153,110; Johnson et al U.S. Pat. No. 5,164,292; Asami U.S. Pat. Nos. 5,166,044 and 5,204,234; Wu U.S. Pat. No. 5,166,045; Yoshida et al U.S. Pat. No. 5,229,263; Bell U.S. Pat. Nos. 5,252,451 and 5,252,530; Komorita et al EPO 0 244 184; Miyoshi et al EPO 0 488 737 and 0 488 601; Ihama et al EPO 0 368 304; Tashiro EPO 0 405 938; Murakami et al EPO 0 509 674 and 0 563 946 and Japanese Patent Application Hei-2[1990]-249588 and Budz WO 93/02390.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, setenocyanate, tellurocyanate, nitrosyl, thionitrosyl, azide, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781 and 5,037,732, Marchetti et al U.S. Pat. No. 4,937,180, Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320. Olm et al U.S. Pat. No. 5,360,712, the disclosure of which is here incorporated by reference, discloses hexacoordination complexes containing organic ligands while Bigelow U.S. Pat. No. 4,092,171 discloses organic ligands in Pt and Pd tetra-coordination complexes.

It is specifically contemplated to incorporate in the ultrathin tabular grains a dopant to reduce reciprocity failure. Iridium is a preferred dopant for decreasing reciprocity failure. The teachings of Carroll, Iwaosa et al, Habu et al, Grzeskowiak et al, Kim, Maekawa et al, Johnson et al, Asami, Yoshida et al, Bell, Miyoshi et al, Tashiro and Murakami et al EPO 0 509 674, each cited above, are here incorporated by reference. These teachings can be applied to the emulsions of the invention merely by incorporating the dopant during silver halide precipitation.

In another specifically preferred form of the invention it is contemplated to incorporate in the face centered cubic crystal lattice of the ultrathin tabular grains a dopant capable of increasing photographic speed by forming shallow electron traps. *Research Disclosure,* Vol. 367, November 1994, Item 36736, contains a comprehensive description of the criteria for selecting shallow electron trapping (SET) dopants.

In a specific, preferred form it is contemplated to employ as a dopant a hexacoordination complex satisfying the formula:

$$[ML_6]^n \quad \text{(IV)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |

It is additionally contemplated to employ oligomeric coordination complexes to increase speed, as taught by Evans et al U.S. Pat. No. 5,024,931, the disclosure of which is here incorporated by reference.

The dopants are effective in conventional concentrations, where concentrations are based on the total silver, including both the silver in the tabular grains and the silver in the protrusions. Generally shallow electron trap forming dopants are contemplated to be incorporated in concentrations of at least $1\times10^{-6}$ mole per silver mole up to their solubility limit, typically up to about $5\times10^{-4}$ mole per silver mole. Preferred concentrations are in the range of from about $10^{-5}$ to $10^{-4}$ mole per silver mole. It is, of course, possible to distribute the dopant so that a portion of it is incorporated in the ultrathin tabular grains and the remainder is incorporated in the silver halide protrusions.

The chemical and spectral sensitizations of this invention improve upon the best chemical and spectral sensitizations disclosed by Maskasky I. That is, in the practice of the present invention ultrathin tabular grains receive during chemical sensitization epitaxially deposited silver halide forming protrusions at selected sites on the ultrathin tabular grain surfaces. Maskasky I observed that the double jet addition of silver and chloride ions during epitaxial deposition onto selected sites of silver iodobromide tabular grains produced the highest increases in photographic sensitivities. In the practice of the present invention it is contemplated that the silver halide protrusions will in all instances be precipitated to contain at least a 10 percent, preferably at least a 15 percent and optimally at least a 20 percent higher chloride concentration than the host ultrathin tabular grains. It would be more precise to reference the higher chloride concentration in the silver halide protrusions to the chloride ion concentration in the epitaxial junction forming portions of the ultrathin tabular grains, but this is not necessary, since the chloride ion concentrations of the ultrathin tabular grains are contemplated to be substantially uniform (i.e., to be at an average level) or to decline slightly due to iodide displacement in the epitaxial junction regions.

Contrary to the teachings of Maskasky I, it has been found that improvements in photographic performance can be realized by adding iodide ions along with silver and chloride ions to the ultrathin tabular grain emulsions while performing epitaxial deposition. Specifically, it has been observed that by limiting the iodide in the ultrathin tabular grains as described above and incorporating in the epitaxially deposited protrusions a higher (preferably at least 1 mole higher) iodide concentration than is present in those portions of the ultrathin tabular grains extending between their {111} major faces and forming epitaxial junctions with the protrusions, it is possible to achieve improved speed-granularity relationships. When the ultrathin tabular grains contain a uniform distribution of iodide, the epitaxially deposited protrusions contain a higher (preferably at least 1 mole percent higher) iodide concentration than the average iodide concentration of the ultrathin tabular grains. Further, it is possible to achieve superior speed-granularity relationships with lower total levels of iodide in the emulsions, which in turn results in higher rates of development and increased contrast. Lowering the iodide level in the ultrathin tabular grains also results in reducing their thicknesses when otherwise comparable precipitation procedures are employed. Since the epitaxially deposited protrusions contain less silver than the ultrathin tabular grains, their iodide concentration can be increased with smaller amounts of iodide than is required to raise the iodide concentration of the ultrathin tabular grains to the same level. This is in itself an advantage in allowing higher local iodide concentrations to be realized with lower overall levels of iodide.

Since iodide ions are much larger than chloride ions, it is recognized in the art that iodide ions can only be incorporated into the face centered cubic crystal lattice structures formed by silver chloride and/or bromide to a limited extent. This is discussed, for example, in Maskasky U.S. Pat. Nos. 5,238,804 and 5,288,603 (hereinafter referred to as Maskasky IV and V). Precipitation at ambient pressure, which is universally practiced in the art, limits iodide inclusion in a silver chloride crystal lattice to less than 13 mole percent. For example, introducing silver along with an 84:16 chloride:iodide molar ratio during silver halide epitaxial deposition resulted in an iodide concentration in the resulting epitaxial protrusions of less than 2 mole percent, based on silver in the protrusions. By displacing a portion of the chloride with bromide much higher levels of iodide can be introduced into the protrusions. For example, introducing silver along with a 42:42:16 chloride:bromide:iodide molar ratio during silver halide epitaxial deposited resulted in an iodide concentration in the resulting epitaxial protrusions of 7.1 mole percent, based on silver in the protrusions. Preferred iodide ion concentrations in the protrusions are in the range of from 1 to 15 mole percent (most preferably 2 to 10 mole percent), based on silver in the protrusions.

It has been discovered quite unexpectedly that further improvements in speed-granularity relationships can be realized by introducing along with silver ions during epitaxial deposition chloride, bromide and iodide ions. Since silver bromide and iodobromide epitaxy on silver iodobromide host tabular grains produces lower levels of sensitization than concurrent introductions of silver, chloride and iodide ions during epitaxy, it was unexpected that displacement of a portion of the chloride with bromide would further increase photographic performance. Analysis indicates that the introduction of chloride and bromide ions during precipitation of the epitaxial protrusions facilitates higher iodide incorporations. This can be explained in terms of the increased crystal cell lattice dimensions imparted by the increased levels of bromide ions. It does not explain why photographic performance increased rather than declining to more closely approximate that imparted by silver iodobromide epitaxial protrusions.

It is believed that the highest levels of photographic performance are realized when the silver halide epitaxy contains both (1) the large differences in chloride concentrations between the host ultrathin tabular grains and the epitaxially deposited protrusions noted above and (2) elevated levels of iodide inclusion in the face centered cubic crystal lattice structure of the protrusions.

One preferred technique relevant to objective (1) is to introduce the different halide ions during precipitation of the protrusions in the order of descending solubilities of the silver halides that they form. For example, if chloride, bromide and iodide ions are all introduced during precipitation of the protrusions, it is preferred to introduce the chloride ions first, the bromide ions second and the iodide ions last. Because silver iodide is less soluble than silver bromide which is in turn less soluble than silver chloride, the sequential order of halide ion addition preferred gives the chloride ion the best possible opportunity for deposition adjacent the junction. A clear stratification of the protrusions into regions exhibiting higher and lower chloride ion concentrations can in some instances be detected, but may not be detectable in every instance in which the preferred sequential halide addition is employed, since both bromide and iodide ions have the capability of displacing chloride to some extent from already precipitated silver chloride.

Increasing iodide levels in the protrusions runs directly contrary to a prior belief in the art that iodide in epitaxially deposited protrusions should be minimized to avoid morphological instability in the host ultrathin tabular grains. However, it has been observed that increased iodide concentrations in the epitaxially deposited protrusions as described above is not incompatible with maintaining the ultrathin tabular configuration of the host grains.

In the practice of the invention the elevated iodide concentrations in the protrusions are those that can be accommodated in a face centered cubic crystal lattice structure of the rock salt type—that is, the type of isomorphic crystal lattice structure formed by silver and one or both of chloride and bromide. It is, of course, possible to incorporate limited amounts (generally cited as 10 mole percent or less) of bromide and/or chloride ions into nonisomorphic β or γ phase silver iodide crystal structures; however, nonisomorphic silver halide epitaxy forms no part of this invention. The structures are too divergent to ascribe similar photographic properties, and nonisomorphic epitaxial protrusions have been demonstrated by Maskasky II to produce much lower levels of sensitization than isomorphic crystal structure silver halide epitaxial protrusions.

Subject to the composition modifications specifically described above, preferred techniques for chemical and spectral sensitization are those described by Maskasky I, cited above and here incorporated by reference. Maskasky I reports improvements in sensitization by epitaxially depositing silver halide at selected sites on the surfaces of the host tabular grains. Maskasky I attributes the speed increases observed to restricting silver halide epitaxy deposition to a small fraction of the host tabular grain surface area. It is contemplated to restrict silver halide epitaxy to those portions nearest peripheral edges of and accounting for less than 50 percent of the {111} major faces of the ultrathin tabular grains and, preferably, to a much smaller percent of the {111} major faces of the ultrathin tabular grains, preferably less than 25 percent, most preferably less than 10 percent, and optimally less than 5 percent of the {111} major faces of the host ultrathin tabular grains. It is preferred to restrict the silver halide epitaxy to those portions of the ultrathin tabular grains that are formed by the laterally displaced regions, which typically includes the edges and corners of the tabular grains.

Like Maskasky I, nominal amounts of silver halide epitaxy (as low as 0.05 mole percent, based on total silver, where total silver includes that in the host and epitaxy) are effective in the practice of the invention. Because of the increased host tabular grain surface area coverages by silver halide epitaxy discussed above and the lower amounts of silver in ultrathin tabular grains, an even higher percentage of the total silver can be present in the silver halide epitaxy. However, in the absence of any clear advantage to be gained by increasing the proportion of silver halide epitaxy, it is preferred that the silver halide epitaxy be limited to 50 percent of total silver. Generally silver halide epitaxy concentrations of from 0.3 to 25 mole percent are preferred, with concentrations of from about 0.5 to 15 mole percent being generally optimum for sensitization.

Maskasky I teaches various techniques for restricting the surface area coverage of the host tabular grains by silver halide epitaxy that can be applied in forming the emulsions of this invention. Maskasky I teaches employing spectral sensitizing dyes that are in their aggregated form of adsorption to the tabular grain surfaces capable of direct silver halide epitaxy to the edges or corners of the tabular grains. Cyanine dyes that are adsorbed to host ultrathin tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In still another form Maskasky I relies on overall iodide levels within the host tabular grains of at least 8 mole percent to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

It is generally accepted that selective site deposition of silver halide epitaxy onto host tabular grains improves sensitivity by reducing sensitization site competition for conduction band electrons released by photon absorption on imagewise exposure. Thus, epitaxy over a limited portion of the major faces of the ultrathin tabular grains is more efficient than that overlying all or most of the major faces, still better is epitaxy that is substantially confined to the edges of the host ultrathin tabular grains, with limited coverage of their major faces, and still more efficient is epitaxy that is confined at or near the corners or other discrete sites of the tabular grains. The spacing of the corners of the major faces of the host ultrathin tabular grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain. When the host ultrathin tabular grains contain a higher iodide concentration in laterally displaced regions, as taught by Solberg et al, it is recognized that enhanced photographic performance is realized by restricting silver halide protrusions to the higher iodide laterally displaced regions.

Silver halide epitaxy can by itself increase photographic speeds to levels comparable to those produced by substantially optimum chemical sensitization with sulfur and/or gold. Additional increases in photographic speed can be realized when the tabular grains with the silver halide epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver halide epitaxy sensitizations are contained in *Research Disclosure,* Vol. 365, September 1994, Item 36544, Section IV. Chemical sensitization. Kofron et al illustrates the application of these sensitizations to tabular grain emulsions.

A specifically preferred approach to silver halide epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

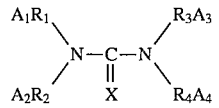

(V)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad (VI)$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver halide epitaxial deposition. Maskasky I teaches the use of J-aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver halide epitaxy, a much broader range of spectral sensitizing dyes is available. The spectral sensitizing dyes disclosed by Kofron et al, particularly the blue spectral sensitizing dyes shown by structure and their longer methine chain analogs that exhibit absorption maxima in the green and red portions of the spectrum, are particularly preferred for incorporation in the ultrathin tabular grain emulsions of the invention. The selection of J-aggregating blue absorbing spectral sensitizing dyes for use as site directors is specifically contemplated. A general summary of useful spectral sensitizing dyes is provided by *Research Disclosure,* Item 36544, Section V. Spectral sensitization and desensitization, A. Sensitizing dyes.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an ultrathin tabular grain according to the invention after chemical sensitization has been completed.

Aside from the features of spectral sensitized, silver halide epitaxy sensitized ultrathin tabular grain emulsions described above, the emulsions of this invention and their preparation can take any desired conventional form. For example, in accordance with conventional practice, after a novel emulsion satisfying the requirements of the invention has been prepared, it can be blended with one or more other novel emulsions according to this invention or with any other conventional emulsion. Conventional emulsion blending is illustrated in *Research Disclosure,* Item 36544, section I, E. Blends, layers and performance categories, the disclosure of which is here incorporated by reference.

The emulsions once formed can be further prepared for photographic use by any convenient conventional technique. Additional conventional features are illustrated by *Research Disclosure* Item 36544, cited above, Section II, Vehicles, vehicle extenders, vehicle-like addenda and vehicle related addenda; Section III, Emulsion washing; Section V, Spectral sensitization and desensitization; Section VI, UV dyes/optical brighteners/luminescent dyes; Section VII, Antifoggants and stabilizers; Section VIII, Absorbing and scattering materials; Section IX, Coating physical property modifying addenda; Section X, Dye image formers and modifiers. The features of Sections VI, VIII, IX and X can alternatively be provided in other photographic element layers. Other features which relate to photographic element construction are found in Section XI, Layers and layer arrangements; XII, Features applicable only to color negative; XIII, Features applicable only to color reversal; XIV, Scan facilitating features; and XV, Supports.

The novel epitaxial silver halide sensitized ultrathin tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning.

In one important aspect this invention is directed to a photographic element containing at least two superimposed radiation sensitive silver halide emulsion layers coated on a conventional photographic support of any convenient type. The emulsion layer coated nearer the support surface is spectrally sensitized to produce a photographic record when the photographic element is exposed to specular light within the visible portion of the visible spectrum. The term "visible" is employed in its art recognized sense to encompass the blue, green and/or red portions of the visible spectrum—i.e., any combination of wavelengths of from 400 to 700 nm. The term "specular light" is employed in its art recognized usage to indicate the type of spatially oriented light supplied by a camera lens to a film surface in its focal plane—i.e., light that is for all practical purposes unscattered.

The second of the two silver halide emulsion layers is coated over the first silver halide emulsion layer. In this arrangement the second emulsion layer is called upon to perform two entirely different photographic functions. The first of these functions is to absorb at least a portion of the light wavelengths it is intended to record. The second emulsion layer can record light in any spectral region ranging from the near ultraviolet (≧300 nm) through the near infrared (≦1500 nm). In most applications both the first and second emulsion layers record images within the visible spectrum. Preferably the first and second emulsion layers record images within different regions of the visible spectrum. The second emulsion layer in most applications records blue or minus blue (500–700 nm) light. Regardless of the wavelength of recording contemplated, the ability of the second emulsion layer to provide a favorable balance of photographic speed and image structure (i.e., granularity and sharpness) is important to satisfying the first function.

The second distinct function which the second emulsion layer must perform is the transmission of visible light intended to be recorded in the first emulsion layer. Whereas the presence of silver halide grains in the second emulsion layer is essential to its first function, the presence of grains, unless chosen as required by this invention, can greatly diminish the ability of the second emulsion layer to perform satisfactorily its transmission function. Since an overlying emulsion layer (e.g., the second emulsion layer) can be the source of image unsharpness in an underlying emulsion layer (e.g., the first emulsion layer), the second emulsion layer is hereinafter also referred to as the optical causer layer and the first emulsion is also referred to as the optical receiver layer.

How the overlying (second) emulsion layer can cause unsharpness in the underlying (first) emulsion layer is explained in detail by Antoniades et al, incorporated by reference, and hence does not require a repeated explanation.

It has been discovered that a favorable combination of photographic sensitivity and image structure (e.g., granularity and sharpness) are realized when silver halide epitaxy sensitized ultrathin tabular grain emulsions satisfying the requirements of the invention are employed to form at least the second, overlying emulsion layer. It is surprising that the presence of silver halide epitaxy on the ultrathin tabular grains of the overlying emulsion layer is consistent with observing sharp images in the first, underlying emulsion layer. Obtaining sharp images in the underlying emulsion layer is dependent on the ultrathin tabular grains in the overlying emulsion layer accounting for a high proportion of total grain projected area; however, grains having an ECD of less than 0.2 μm, if present, can be excluded in calculating total grain projected area, since these grains are relatively optically transparent. Excluding grains having an ECD of less than 0.2 μm in calculating total grain projected area, it is preferred that the overlying emulsion layer containing the silver halide epitaxy sensitized ultrathin tabular grain emulsion of the invention account for greater than 97 percent, preferably greater than 99 percent, of the total projected area of the silver halide grains.

Except for the possible inclusion of grains having an ECD of less than 0.2 μm (hereinafter referred to as optically transparent grains), the second emulsion layer consists almost entirely of ultrathin tabular grains. The optical transparency to minus blue light of grains having ECD's of less 0.2 μm is well documented in the art. For example, Lippmann emulsions, which have typical ECD's of from less than 0.05 μm to greater than 0.1 μm, are well known to be optically transparent. Grains having ECD's of 0.2 μm exhibit significant scattering of 400 nm light, but limited scattering of minus blue light. In a specifically preferred form of the invention the tabular grain projected areas of greater than 97% and optimally greater than 99% of total grain projected area are satisfied excluding only grains having ECD's of less than 0.1 (optimally 0.05) μm. Thus, in the photographic elements of the invention, the second emulsion layer can consist essentially of tabular grains contributed by the ultrathin tabular grain emulsion of the invention or a blend of these tabular grains and optically transparent grains. When optically transparent grains are present, they are preferably limited to less than 10 percent and optimally less than 5 percent of total silver in the second emulsion layer.

The advantageous properties of the photographic elements of the invention depend on selecting the grains of the emulsion layer overlying the first emulsion layer to have a specific combination of grain properties. First, the tabular grains contain photographically significant levels of iodide. The iodide content imparts art recognized advantages over comparable silver bromide emulsions in terms of speed and, in multicolor photography, in terms of interimage effects. Second, having an extremely high proportion of the total grain population as defined above accounted for by the tabular grains offers a sharp reduction in the scattering of visible light when coupled with an average ECD of at least 0.7 μm and an average grain thickness of less than 0.07 μm. The mean ECD of at least 0.7 μm is, of course, advantageous apart from enhancing the specularity of light transmission in allowing higher levels of speed to be achieved in the second emulsion layer. Third, employing ultrathin tabular grains makes better use of silver and allows lower levels of granularity to be realized. Finally, the presence of silver halide epitaxy allows unexpected increases in photographic sensitivity to be realized.

In one simple form the photographic elements can be black-and-white (e.g., silver image forming) photographic elements in which the underlying (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

EXAMPLES

The invention can be better appreciated by reference to following specific examples of emulsion preparations, emulsions and photographic elements satisfying the requirements of the invention. Photographic speeds are reported as relative log speeds, where a speed difference of 30 log units equals a speed difference of 0.3 log E, where E represents exposure in lux-seconds. Contrast is measured as mid-scale contrast. Halide ion concentrations are reported as mole percent (M %), based on silver.

Ultrathin Emulsion A

A vessel equipped with a stirrer was charged with 6 L of water containing 3.75 g lime-processed bone gelatin, 4.12 g NaBr, an antifoamant, and sufficient sulfuric acid to adjust pH to 1.8, at 39° C. During nucleation, which was accomplished by balanced simultaneous addition of $AgNO_3$ and halide (98.5 and 1.5M % NaBr and KI, respectively) solutions, both at 2.5M, in sufficient quantity to form 0.01335 mole of silver iodobromide, pBr and pH remained approximately at the values initially set in the reactor solution. Following nucleation, the reactor gelatin was quickly oxidized by addition of 128 mg of Oxone™ ($2KHSO_5.KHSO_4.K_2SO_4$, purchased from Aldrich) in 20 cc of water, and the temperature was raised to 54° C. in 9 min. After the reactor and its contents were held at this temperature for 9 min, 100 g of oxidized methionine lime-processed bone gelatin dissolved in 1.5 L $H_2O$ at 54° C. were added to the reactor. Next the pH was raised to 5.90, and 122.5 cc of 1M NaBr were added to the reactor. Twenty four and a half minutes after nucleation the growth stage was begun during which 2.5M $AgNO_3$, 2.8M NaBr, and a 0.148M suspension of AgI (Lippmann) were added in proportions to maintain (a) a uniform iodide level of 4.125M % in the growing silver halide crystals and (b) the reactor pBr at the value resulting from the cited NaBr additions prior to the start of nucleation and growth, until 0.848 mole of silver iodobromide had formed (53.33 min, constant flow rates), at which time the excess $Br^-$ concentration was increased by addition of 105 cc of 1M NaBr; the reactor pBr was maintained at the resulting value for the balance of the growth. The flow of the cited reactants was then resumed and the flow was accelerated such that the final flow rate at the end of the segment was approximately 12.6 times that at the beginning; a total of 9 moles of silver iodobromide (4.125M % I) was formed. When addition of $AgNO_3$, AgI and NaBr was complete, the resulting emulsion was coagulation washed and the pH and pBr were adjusted to storage values of 6 and 2.5, respectively.

The resulting emulsion was examined by scanning electron micrography (SEM). More than 99.5% of the total grain projected area was accounted for by tabular grains. The mean ECD of the emulsion grains 1.89 μm, and their COV was 34. Since tabular grains accounted for very nearly all of the grains present, mean grain thickness was determined using a dye adsorption technique: The level of 1,1'-diethyl- 2,2'-cyanine dye required for saturation coverage was determined, and the equation for surface area was solved assuming the solution extinction coefficient of this dye to be 77,300 L/mole-cm and its site area per molecule to be 0.566 $nm^2$.

This approach gave a mean grain thickness value of 0.053 μm.

Thin Emulsion B

This emulsion was precipitated exactly as Emulsion A to the point at which 9 moles of silver iodobromide had been formed, then 6 moles of the silver iodobromide emulsion were taken from the reactor. Additional growth was carried out on the 3 moles which were retained in the reactor to serve as seed crystals for further thickness growth. Before initiating this additional growth, 17 grams of oxidized methionine lime-processed bone gelatin in 500 cc water at 54° C. was added, and the emulsion pBr was adjusted to ca. 3.3 by the slow addition of $AgNO_3$ alone until the pBr was about 2.2, followed by an unbalanced flow of $AgNO_3$ and NaBr. While maintaining this high pBr value and a temperature of 54° C., the seed crystals were grown by adding $AgNO_3$ and a mixed halide salt solution that was 95.875M % NaBr and 4.125M % KI until an additional 4.49 moles of silver iodobromide (4.125M % I) was formed; during this growth period, flow rates were accelerated 2x from start to finish. The resulting emulsion was coagulation washed and stored similarly as Emulsion A.

The resulting emulsion was examined similarly as Emulsion A. More than 99.5% of the total grain projected area was provided by tabular grains. The mean ECD of this emulsion was 1.76 μm, and their COV was 44. The mean thickness of the emulsion grains, determined from dye adsorption measurements like those described for Emulsion A, was 0.130 μm.

Sensitizations

Samples of the emulsions were next sensitized with and without silver salt epitaxy being present.

Epitaxial Sensitization Procedure

A 0.5 mole sample of the emulsion was melted at 40° C. and its pBr was adjusted to ca. 4 with a simultaneous addition of $AgNO_3$ and KI solutions in a ratio such that the small amount of silver halide precipitated during this adjustment was 12% I. Next, 2M % NaCl (based on the original amount of silver iodobromide host) was added, followed by addition of spectral sensitizers Dye 1 [anhydro-9-ethyl-5', 6'-dimethyoxy-5-phenyl-3'-(3-sulfopropyl)-3-(3-sulfobutyl)oxathiacarbocyanine hydroxide] and Dye 2 [anhydro-5,5'-dichloro-9-ethyl-3,3'-bis(3-sulfopropyl)thiacarbocyanine hydroxide, sodium salt], after which 6M % AgCl epitaxy was formed by a balanced double jet addition of $AgNO_3$ and NaCl solutions. This procedure produced epitaxial growths mainly on the corners and edges of the host tabular grains.

The epitaxially sensitized emulsion was split into smaller portions in order to determine optimal levels of subsequently added sensitizing components, and to test effects of level variations. The post-epitaxy components included additional portions of Dyes 1 and 2, 60 mg NaSCN/mole Ag, $Na_2S_2O_3.5H_2O$ (sulfur), $KAuCl_4$ (gold), and 11.44 mg 1-(3-acetamidophenyl)-5-mercaptotetrazole (APMT)/mole Ag. After all components were added the mixture was heated to 60° C. to complete the sensitization, and after cool-down, 114.4 mg additional APMT was added.

The resulting sensitized emulsions were coated on a cellulose acetate film support over a gray silver antihalation layer, and the emulsion layer was overcoated with a 4.3 $g/m^2$ gelatin layer containing surfactant and 1.75 percent by weight, based on total weight of gelatin, of bis(vinylsulfonyl)methane hardener. Emulsion laydown was 0.646 g $Ag/m^2$ and this layer also contained 0.323 $g/m^2$ and 0.019 $g/m^2$ of Couplers 1 and 2, respectively, 10.5 $mg/m^2$ of 4-hydroxy-6-methyl-1,3,3a,7-tetraazaindene ($Na^+$ salt), and 14.4 $mg/m^2$ 2-(2-octadecyl)-5-sulfohydroquinone ($Na^+$ salt), surfactant and a total of 1.08 g $gelatin/m^2$. The emulsions so coated were given 0.01 sec Wratten 23A™ filtered (wavelengths >560 nm transmitted) daylight balanced light exposures through a calibrated neutral step tablet, and then were developed using the color negative Kodak Flexicolor™ C41 process. Speed was measured at a density of 0.15 above minimum density.

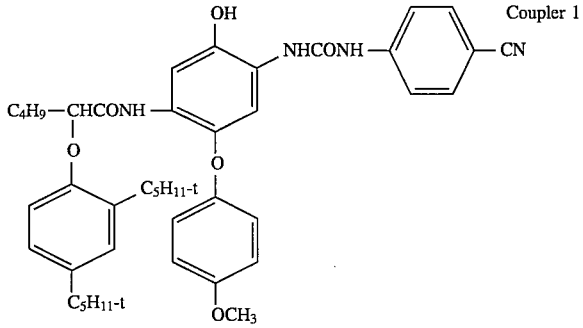

Coupler 1

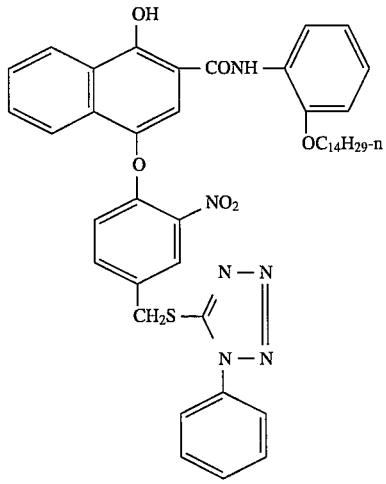

Coupler 2

Nonepitaxial Sensitization Procedure

This sensitization procedure was similar to that described for epitaxial sensitizations, except that the epitaxial deposition step was omitted. Thus after adjusting the initial pBr to ca. 4, suitable amounts of Dye 1 and Dye 2 were added, then NaSCN, sulfur, gold and APMT were added as before, and this was followed by a heat cycle at 60° C.

Optimization

Beginning levels for spectral sensitizing dye, sulfur and gold sensitizers were those known to be approximately optimal from prior experience, based on mean grain ECD and thickness. Sensitization experiments were then conducted in which systematic variations were made in levels of dye, sulfur and gold. Reported below in Tables I and II are the highest speeds that were observed in sensitizing the thin and ultrathin tabular grain emulsions A and B, respectively. In Table III the contrasts are reported of the epitaxially sensitized thin and ultrathin tabular grain emulsions A and B reported in Tables I and II.

TABLE I

| Speed Increase Attributable to Epitaxy on Thin Host Tabular Grains | | | |
|---|---|---|---|
| Host Emulsion | Type of Sensitization | Dmin | Relative Log Speed |
| Emulsion B | Nonepitaxial | 0.11 | 100 |
| Emulsion B | Epitaxial | 0.15 | 130 |

TABLE II

| Speed Increase Attributable to Epitaxy on Ultrathin Tabular Grains | | | |
|---|---|---|---|
| Host Emulsion | Type of Sensitization | Dmin | Relative Log Speed |
| Emulsion A | Nonepitaxial | 0.14 | 100 |
| Emulsion A | Epitaxial | 0.15 | 150 |

TABLE III

| Contrast Comparisons of Epitaxially Sensitized Thin and Ultrathin Tabular Emulsions. | | | |
|---|---|---|---|
| Host Emulsion | Emulsion Type | Sensitization | Contrast |
| Emulsion B | Thin | Epitaxial | 0.68 |
| Emulsion A | Ultrathin | Epitaxial | 0.89 |

Tables I and II demonstrate that the speed gain resulting from epitaxial sensitization of an ultrathin tabular grain emulsion is markedly greater than that obtained by a comparable epitaxial sensitization of a thin tabular grain emulsion. Table III further demonstrates that the epitaxially sensitized ultrathin tabular grain emulsion further exhibits a higher contrast than the similarly sensitized thin tabular grain emulsion.

Specularity Comparisons

The procedure for determining the percent normalized specular transmittance of light through coatings of emulsions as outlined in Antoniades et al Example 6 was employed. Table IV summarizes data for the spectrally and epitaxially sensitized thin and ultrathin tabular emulsions described above in terms of percent normalized specular transmittance (% NST), with normalized specular transmittance being the ratio of the transmitted specular light to the total transmitted light. The percent transmittance and the percent normalized specular transmittance at either 450 nm or 550 nm were plotted versus silver laydown. The silver laydown corresponding to 70 percent total transmittance was determined from these plots and used to obtain the percent specular transmittance at both 450 and 550 nm.

TABLE IV

| Specularity Comparisons | | | | |
|---|---|---|---|---|
| Host | Sp. Sens. | M % AgCl | % NST | |
| Emulsion | Dyes | Epitaxy | 450 nm | 550 nm |
| thin Emulsion B | 1 & 2 | 6 | 20.7 | 18.6 |
| ultrathin Emulsion A | 1 & 2 | 6 | 70.7 | 71.6 |

From Table IV it is apparent that epitaxially sensitized ultrathin tabular grain emulsions exhibit a dramatic and surprising increase in percentage of total transmittance accounted for by specular transmittance as compared to thin tabular grain emulsions.

Spectrally Displaced Absorptions

The same coatings reported in Table IV that provided 70 percent total transmittance at 550 nm were additionally examined to determine their absorption at shorter wavelengths as compared to their absorption at the peak absorption wavelength provided by Dyes 1 and 2, which was 647 nm. The comparison of 600 nm absorption to 647 nm absorption is reported in Table V, but it was observed that absorptions at all off-peak wavelengths are lower with epitaxially sensitized ultrathin tabular grain emulsions than with similarly sensitized thin tabular grain emulsions.

TABLE V

| Relative Off-Peak Absorption | | | |
|---|---|---|---|
| Host Emulsion | Dyes | Mole % Epitaxy | Relative Absorption A600/A647 |
| thin Emulsion B | 1 & 2 | 6 | 0.476 |
| ultrathin Emulsion A | 1 & 2 | 6 | 0.370 |

From Table V it is apparent that the spectrally and epitaxially sensitized ultrathin tabular grain emulsion exhibited significantly less off-peak absorption than the compared similarly sensitized thin tabular grain emulsion.

Emulsion C

This emulsion was prepared in a manner similar to that described for Emulsion A, but with the precipitation procedure modified to provide a higher uniform iodide concentration ($AgBr_{0.88}I_{0.12}$) during growth and a smaller grain size.

Measuring grain parameters similarly as for Emulsion A, it was determined that in Emulsion C 99.4% of the total grain projected area was provided by tabular grains, the mean grain ECD was 0.95 μm (COV=61), and the mean grain thickness was 0.049 μm.

Specularity as a Function of Epitaxial Levels

Formation of AgCl epitaxy on the host ultrathin tabular grains of Emulsion C followed the general procedure described above for epitaxial sensitizations with flow rates typically such that 6 mole-% epitaxy formed per min, or higher. The emulsion samples were not sulfur or gold sensitized, since these sensitizations have no significant influence on specularity. In addition to spectral sensitizing Dye 2, the following alternative spectral sensitizing dyes were employed:

Dye 3: Anhydro-6,6'-dichloro-1,1'-diethyl-3,3'-bis(3-sulfopropyl)-5,5'-bis(trifluoromethyl)benzimidazolocarbocyanine hydroxide, sodium salt;

Dye 4: Anhydro-5-chloro-9-ethyl-5'-phenyl-3'-(3-sulfobutyl)-3-(3-sulfopropyl)oxacarbocyanine hydroxide, triethylammonium salt;

Dye 5: Anhydro-5,5'-dichloro-3,3'-bis(3-sulfopropyl)thiacyanine hydroxide, triethylammonium salt.

Since epitaxial deposition produces stoichiometric related amounts of sodium nitrate as a reaction by-product, which, if left in the emulsion when coated, could cause a haziness that could interfere with optical measurements, these epitaxially treated emulsions were all coagulation washed to remove such salts before they were coated.

TABLE VI

The Effect of Differing Levels of Epitaxy on the Specularity of Ultrathin Tabular Grain Emulsions

| | Mole % | % NST | | |
|---|---|---|---|---|
| Dye(s) | Epitaxy | 450 nm | 550 nm | 650 nm |
| 2 | 0 | 71.4 | 68.4 | — |
| 2 | 12 | 65.7 | 67.0 | — |
| 2 | 24 | 65.7 | 61.4 | — |
| 2 | 36 | 64.0 | 64.3 | — |
| 2 | 100 | 50.7 | 52.9 | — |
| 3 & 4 | 0 | — | — | 59.3 |
| 3 & 4 | 12 | — | — | 57.1 |
| 5 | 0 | — | 62.9 | 60.9 |
| 5 | 12 | — | 57.6 | 57.7 |

Data in Table VI show that specularity observed for the host emulsion lacking epitaxy is decreased only slightly after epitaxy is deposited. Even more surprising is the high specularity that is observed with high levels of epitaxy. Note that specularity at 450 and 550 nm remains high as the level of epitaxy is increased from 0 to 100%. The percent normalized specular transmittance compares favorably with that reported by Antoniades et al in Table IV, even though Antoniades et al did not employ epitaxial sensitization. It is to be further noted that the acceptable levels of specular transmittance are achieved even when the level of epitaxy is either higher than preferred by Maskasky I or even higher than taught by Maskasky I to be useful.

Robustness Comparisons

To determine the robustness of the emulsions of the invention Emulsion A was sulfur and gold sensitized, with an without epitaxial sensitization, similarly as the emulsions reported in Table II, except that the procedure for optimizing sensitization was varied so that the effect of having slightly more or slightly less spectral sensitizing dye could be judged.

A preferred level of spectral sensitizing dye and sulfur and gold sensitizers was arrived at in the following manner: Beginning levels were selected based on prior experience with these and similar emulsions, so that observations began with near optimum sensitizations. Spectral sensitizing dye levels were varied from this condition to pick a workable optimum spectral sensitizing dye level, and sulfur and gold sensitization levels were then optimized for this dye level. The optimized sulfur ($Na_2S_2O_3.5H_2O$) and gold ($KAuCl_4$) levels were 5 and 1.39 mg/Ag mole, respectively.

With the optimized sulfur and gold sensitization selected, spectral sensitizing dye levels were varied to determine the degree to which differences in dye level affected emulsion sensitivity. The results are summarized in Table VII.

TABLE VII

Robustness Tests: Ultrathin Tabular Grain Emulsions Optimally Sulfur and Gold Sensitized Without Epitaxy

| Description | Dye 1 mM/Ag M | Dye 2 mM/Ag M | Rel. Speed | Dmin | Δ Speed |
|---|---|---|---|---|---|
| Mid Dye | 0.444 | 1.731 | 100 | 0.14 | check |
| High Dye | 0.469 | 1.827 | 117 | 0.14 | +17 |
| Low Dye | 0.419 | 1.629 | 84 | 0.15 | −16 |

For each one percent change in dye concentration speed varied 2.73 log speed units. When the speed variance was examined on a second occasion, a one percent concentration variance in spectral sensitizing dye resulted in a speed variation of 4.36 log speed units. The run to run variance merely served to reinforce the observed lack of robustness of the emulsions lacking epitaxy.

The experiments reported above were repeated, except that Emulsion A additionally received an epitaxial sensitization similarly as the epitaxialy sensitized emulsion in Table II. The optimized sulfur ($Na_2S_2O_3.5H_2O$) and gold ($KAuCl_4$) levels were 2.83 and 0.99 mg/Ag mole, respectively. The results are summarized in Table VIII below:

TABLE VIII

Robustness Tests: Ultrathin Tabular Grain Emulsions Optimally Sulfur and Gold Sensitized With Epitaxy

| Description | Dye 1 mM/Ag M | Dye 2 mM/Ag M | Rel. Speed | Dmin | Δ Speed |
|---|---|---|---|---|---|
| Mid Dye | 0.444 | 1.73 | 100 | 0.14 | check |
| High Dye | 0.469 | 1.83 | 107 | 0.15 | +7 |
| Low Dye | 0.419 | 1.63 | 91 | 0.13 | −9 |

For each one percent change in dye concentration speed varied only 1.31 log speed units. This demonstrated a large and unexpected increase in the robustness of the epitaxially sensitized ultrathin tabular grain emulsion.

Emulsion D

This emulsion was prepared according to the procedure described in Antoniades et al U.S. Pat. No. 5,250,403 for emulsion TE-4 with slight modifications:

A reaction vessel equipped with a stirrer was charged with 9 L distilled water, 13.5 g of oxidized bone gelatin, 18 g of ammonium sulfate, 15 mL of 5M sodium bromide solution, an antifoamant and enough sulfuric acid to bring the pH to 2.5. The temperature of the reaction vessel was brought to 35° C. and nucleation was performed by making a balanced double jet addition of 12 mL each of 2.5M silver nitrate solution and 2.5M halide solution, the halides consisting of 98.5 mole % sodium bromide and 1.5 mole % potassium iodide at a flow rate of 120 mL/min.

Following nucleation, 100 g of oxidized bone gelatin dissolved in a total of 1.5 L water was added to the reaction vessel, and the pH was adjusted to 10.0 with 1M NaOH. The reaction vessel was stirred for 15 minutes, and then the pH was adjusted down to 5.8 with 1N sulfuric acid. The reaction vessel temperature was raised to 45° C. over a period of 6 minutes, and pBr was adjusted to 1.74 with 4M NaBr. Growth was begun by simultaneous addition of 3.8M silver nitrate and a 0.1242M suspension of silver iodide each at a rate of 5 mL/min together with the addition of 4.0M sodium bromide at such a rate that the pBr was maintained at 1.74.

The silver nitrate and silver iodide flows were gradually increased at equal rates to a value of 40 mL/min over a period of 2 hours while maintaining the pBr at 1.74 by controlling the flow of sodium bromide.

When 95 percent of the total amount of silver had been added, the flow of silver iodide was terminated so that the last 5% of the make consisted of a silver bromide shell. The emulsion was washed and concentrated by an ultrafiltration method until the pBr reached a value of 8.3. Enough gelatin was added to bring the gelatin content of 40 g gelatin per mole silver.

The final yield was 9 moles of a silver iodobromide ultrathin tabular grain emulsion containing 3 mole percent iodide. More than 90 percent of total grain projected area was accounted for by tabular grains. The grains exhibited an average ECD of 1.95 μm and an average thickness of 0.067 μm.

Varied Iodide Sensitizations

Samples of Emulsion D were identically sensitized by the epitaxial deposition of 6 mole percent silver halide onto the edges and corners of the host ultrathin tabular grains.

This was accomplished by first adjusting the pBr to about 4 at 40° C. by balanced volume double jet addition of 0.05M silver nitrate and 0.006M potassium iodide solutions. Next, 0.005 mole/Ag mole of potassium iodide and 5.3 mL/Ag mole of a 3.76M sodium chloride solution were added, followed by a combination of the spectral sensitizing dyes Dye 6 (Dye 2, but with a triethylammonium counter ion substituted for sodium) at a concentration of 1.62 mmol/Ag mole and Dye 7, 5-[di(1-ethyl-2(1H)-naphtho[1,2]thiazolylideneisopropylidene]-1,3-di(β-methoxyethyl)barbituric acid, at a concentration of 0.04 mmole/Ag mole.

The dyed emulsion samples were held at 40° C. for 30 minute, followed by additions of 0.25M NaCl, 0.25M KBr (where employed) and AgI (Lippmann) (where employed) giving the added (nominal) proportions set out in Table IX below and summing to 6 mole percent, based on the silver in the host emulsion sample. These additions were followed by the subsurface addition of 0.5M silver nitrate solution with stirring over a period of 1 minute in a stoichiometric amount, based on the chloride and bromide additions of this paragraph.

The emulsions were further sensitized by the addition of sodium thiocyanate (60 mg/Ag mole), followed by the addition of the sulfur sensitizer 1,3-dicarboxymethyl-1,3-dimethyl-2-thourea and the gold sensitizer bis(1,3,5-trimethyl-1,2,4-triazolium-3-thiolate) gold(I) tetrafluoroborate in optimum amounts determined by previous sensitizations and observations of performance. Next, 11.44 mg of the antifoggant AMPT were added. Then the temperature was raised to 50° C. at a rate of 5° C./3 minute interval and held for 5 minutes before cooling to 40° C. at a rate of 6.6° C./3 minute interval. Then an additional 114.4 mg of APMT were added.

The sensitized emulsion samples were coated on a cellulose acetate film support with an antihalation backing. The coatings contained 5.38 mg/dm$^2$ Ag, 21.53 mg/dm$^2$ gelatin, 9.69 mg/dm$^2$ cyan dye-forming coupler (Coupler 3), 2 g/Ag mole 4-hydroxy-6-methyl-1,3,3a,7-tetraazaindene stabilizer and surfactants. A protective gelatin overcoat was applied containing hardener was coated over the emulsion layer.

Coupler 3

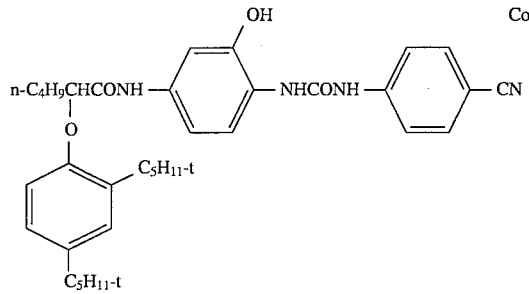

The dried coated samples were given 0.01 sec Wratten 23A™ filtered (wavelengths >560 nm transmitted) daylight (5500° K) light exposures through a 21 step calibrated neutral step tablet. The exposed samples were developed in the color negative Kodak Flexicolor™ C41 process. Speed was measured at density of 0.15 above minimum density.

Granularity measurements were made according to the procedures described in the *SPSE Handbook of Photographic Science and Engineering*, W. Thomas, Ed., pp. 934–939. The granularity readings at each step were divided by the gamma (ΔD+Δlog E, where D=density and E=exposure in lux-seconds) at each step and plotted vs. log E. In these plots there is typically a minimum. The minimum of this gamma-normalized granularity allows a comparison of coatings having differing contrast. Lower values indicate lower granularity.

The results are summarized in Table IX.

TABLE IX

| Sample | Epitaxy Halide Added | | Dmin | Relative Log Speed | Minimum Normalized Granularity (× $10^3$) |
|---|---|---|---|---|---|
| D-1 | Cl | 100% | 0.08 | 100 | 18.6 |
| D-2 | Cl | 92% | 0.09 | 110 | 18.2 |
| | I | 8% | | | |
| D-3 | Cl | 84% | 0.11 | 104 | 18.1 |
| | I | 16% | | | |
| D-4 | Cl | 63% | 0.07 | 105 | 16.5 |
| | Br | 21% | | | |
| | I | 16% | | | |
| D-5 | Cl | 42% | 0.05 | 110 | 16.6 |
| | Br | 42% | | | |
| | I | 16% | | | |
| D-6 | Cl | 46% | 0.08 | 104 | 18.1 |
| | Br | 46% | | | |
| | I | 8% | | | |
| D-7 | Cl | 38% | 0.09 | 105 | 17.1 |
| | Br | 38% | | | |
| | I | 24% | | | |

From Table IX it is apparent that increasing the concentration of iodide in the epitaxy increases speed and reduces granularity while minimum density remains fully acceptable.

Analytical electron microscopy (AEM) techniques were employed to determine the actual as opposed to nominal (input) compositions of the silver halide epitaxial protrusions. The general procedure for AEM is described by J. I. Goldstein and D. B. Williams, "X-ray Analysis in the TEM/STEM", *Scanning Electron Microscopy*/1977; Vol. 1, IIT Research Institute, March 1977, p. 651. The composition of an individual epitaxial protrusion was determined by focusing an electron beam to a size small enough to irradiate only the protrusion being examined. The selective location of the epitaxial protrusions at the corners of the host tabular grains facilitated addressing only the epitaxial protrusions.

Each corner epitaxial protrusion on each of 25 grains was examined for each of the sensitizations. The results are summarized in Table X.

TABLE X

| Sample | Halide Added | | Halide in Epitaxy: Halide Found Cl | Br | I |
|---|---|---|---|---|---|
| D-1 | Cl | 100% | 42.3% | 57.1% | 0.6% |
| D-3 | I | 16% | | | |
| | Cl | 84% | 46.4% | 48.1% | 5.5% |
| D-4 | Cl | 63% | | | |
| | Br | 21% | | | |
| | I | 16% | 26.0% | 65.8% | 8.2% |
| D-5 | Cl | 42% | | | |
| | Br | 42% | | | |
| | I | 16% | 12.4% | 80.5% | 7.1% |

The minimum AEM detection limit was a halide concentration of 0.5M %.

From Table X, referring to D-1, it is apparent that, even when chloride was the sole halide added to the silver iodobromide ultrathin tabular grain emulsion during precipitation of the epitaxial protrusions, migration of iodide ion from the host emulsion into the epitaxy was low, less than 1 mole percent, but bromide ion inclusion was higher, probably due to the greater solubility of AgBr in AgCl compared to the solubility of AgI in AgCl.

Referring to D-3, when iodide was added along with chloride during epitaxial deposition, the iodide concentration was increased above the 3M % level of iodide in the host tabular grains while bromide inclusion in the epitaxy remained relatively constant.

Referring to D-3 and D-4, when at least 21% of the chloride was replaced by bromide, the iodide concentration was further increased as compared to D-3, even though the same amount of iodide was added in each sensitization.

Emulsion E

To prepare Emulsion E-1, Emulsion D-5 was remade, except that the spectral sensitizing dyes were replaced with 0.37 mmole/Ag mole Dye 3 and 1.10 mmole/Ag mole Dye 4.

Emulsion E-2 was prepared similarly to Emulsion E-1, except that 17 μmole per mole of total silver of SET-2 was added during epitaxial deposition.

Except as noted, sensitization, coating, exposure and processing were similar to that of the samples of Emulsion D. A Wratten 9 filter (transmission at wavelengths longer than 460 nm) was substituted for the Wratten 23A filter employed to expose samples of Emulsion D.

The results are summarized in Table XI.

TABLE XI

| Sample | Dopant | Dmin | Relative Log Speed |
|---|---|---|---|
| E-1 | None | 0.05 | 100 |
| E-2 | SET-2 | 0.07 | 123 |

From Tables IX and XI it is apparent that the speed enhancement attributable to the inclusion of iodide in the epitaxy shown in Table IX can be further enhanced by the incorporation of a shallow electron trapping site dopant in the epitaxy.

Emulsion F

This emulsion was prepared to demonstrate that decreasing the thickness of the host tabular grains further is not detrimental to photographic speed and results in a further reduction in granularity.

Emulsion F was prepared using a modification of the procedure of Example 3 of Antoniades et al U.S. Pat. No. 5,250,403.

Silver bromide grain nuclei were generated in a continuous double jet stirred reaction vessel at a pBr of 2.3, a temperature of 40° C., a nuclei suspension density of 0.033 mole of silver bromide per liter, an average residence time of 1.5 seconds, and an average oxidized gelatin concentration of 2 g/L. The grain nuclei generation was carried out by mixing at steady state in the continuous reaction vessel a solution of oxidized gelatin (2.4 g/L) at 1 L per minute with a sodium bromide solution (0.47M) at 0.1 L per minute and a silver nitrate solution (0.4M) at 0.1 L per minute. The output of the continuous precipitation were allowed to come to steady state before being used in the subsequent precipitation steps.

The silver bromide grain nuclei were transferred to a semi-batch reaction vessel over a period of 1 minute. Initially the semi-batch reaction vessel was at a pBr of 3.2, a temperature of 70° C. and a pH of 4.5. The semi-batch reaction vessel initially contained oxidized gelatin at a concentration of 2 g/L and a total volume of 13 L that was subsequently maintained at this level by ultrafiltration. The initial conditions within the semi-batch reaction vessel were chosen to minimize Ostwald ripening while the silver bromide grain nuclei were being introduced.

When the transfer of grain nuclei was completed, the pBr of the semi-batch reaction vessel was changed to 1.6 by rapidly adding a sodium bromide solution. This step promoted twinning of the grain nuclei to form tabular grain nuclei. The twinned nuclei were allowed to ripen at a pBr of 1.6 for 1 minutes while the temperature of the semi-batch reaction vessel was maintained at 70° C. At the conclusion of the 6 minute holding period the pBr within the reaction vessel was increased to 1.9 using ultrafiltration washing over a period of less than 10 minutes.

During the subsequent growth step all reactants were added through the continuous reaction vessel used for nuclei formation. The reactants added, mixed in the continuous reaction vessel, were a solution of oxidized gelatin (pH 4.5, 5 g/L, 0.5 L/min), a silver nitrate solution (0.67M), and a mixed salt solution of sodium bromide and potassium iodide (0.67M, 2.8M % iodide). The silver nitrate solution flow rate was ramped from 0.02 L/min to 0.08 L/min over a period of 30 minutes and the from 0.08 L/min to 0.13 L/min over 30 minutes, and finally from 0.13 to 0.14 L/min over a period of 10 minutes. The pBr of the continuous reaction vessel during this growth step was maintained at 2.6 by controlled the mixed salts solution flow rate. The contents of the continuous reaction vessel were maintained at 30° C. The pBr of the semi-batch reactor during growth was controlled at a pBr of 1.9 by the direct addition of a sodium bromide solution to this reaction vessel as required, and the temperature of the contents of the semi-batch reaction vessel was maintained at 70° C. Thus, the continuous reaction vessel was used for mixing reactants while the semi-batch reaction vessel was used for grain growth.

Greater than 97 percent of total grain projected area was accounted for by tabular grains in the completed emulsion. The average ECD of the grains was 1.9 μm while the average thickness of the tabular grains was 0.034 μm.

Emulsion F was sensitized similarly as Emulsion D-5, except that a combination of a spectral sensitizing dyes Dye 6 (2.99 mmole/Ag mole) and Dye 8, anhydro-3,3'-bis(3-sulfopropyl)-11-ethylnaphtho[1,2-d]dithiazolocarbocyanine hydroxide, triethylammonium salt, (0.33 mmole/Ag mole) were used and the amount of the silver halide epitaxy was increased to 10 percent, based on the silver in the host tabular grain emulsion.

Except as noted, sensitization, coating, exposure and processing were similar to that of the samples of Emulsion D.

Table XII provides a comparison with Emulsion D-5.

TABLE XII

| Sample | ECD (μm) | t (μm) | Relative Log Speed | Minimum Normalized (× $10^3$) |
|---|---|---|---|---|
| D-5 | 1.95 | 0.067 | 110 | 16.6 |
| F | 1.90 | 0.034 | 112 | 11.9 |

Emulsions D-5 and F have approximately the same average ECD and are about the same speed. However, emulsion F has only about half the average tabular grain thickness of emulsion D-5. Therefore, it is apparent that the thickness reduction introduces no speed penalty. On the other hand, the granularity of Emulsion F is significantly lower than that of Emulsion D-5. This demonstrates a significantly improved speed-granularity relationship for thinner tabular grain emulsions satisfying the requirements of the invention.

The invention has been described in detail with particular reference to preferred embodiments thereof, but it will be understood that variations and modifications can be effected within the spirit and scope of the invention.

What is claimed is:

1. A radiation-sensitive emulsion comprised of (1) a dispersing medium, (2) silver halide grains including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and (3) a spectral sensitizing dye adsorbed to the surfaces of the tabular grains, wherein the tabular grains contain less than 10 mole percent iodide and the surface chemical sensitization sites include epitaxially deposited silver halide protrusions of a face centered cubic crystal lattice structure of the rock salt type forming epitaxial junctions with the tabular grains, the protrusions (a) being restricted to those portions of the tabular grains located nearest peripheral edges of and accounting for less than 50 percent of the {111} major faces of the tabular grains, (b) containing a silver chloride concentration at least 10 mole percent higher than that of the tabular grains, and (c) including a higher iodide concentration than those portions of the tabular grains extending between the {111} major faces and forming epitaxial junctions with the protrusions.

2. An emulsion according to claim 1 wherein said tabular grains contain less than 6 mole percent iodide.

3. An emulsion according to claim 2 wherein said tabular grains contain less than 4 mole percent iodide.

4. An emulsion according to claim 1 wherein said protrusions contain from 1 to 15 mole percent iodide.

5. An emulsion according to claim 4 wherein said protrusions contain from 2 to 10 mole percent iodide.

6. An emulsion according to claim 1 wherein said protrusions contain at least 15 mole percent higher chloride ion concentrations than said tabular grains.

7. An emulsion according to claim 6 wherein said protrusions contain at least 20 mole percent higher chloride ion concentrations than said tabular grains.

8. An emulsion according to claim 1 wherein said protrusions account for from 0.3 to 25 percent of total silver.

9. An emulsion according to claim 1 where the epitaxially deposited silver halide protrusions are located on less than 25 percent of the tabular grain surfaces.

10. An emulsion according to claim 9 wherein the epitaxially deposited silver halide protrusions are predominantly located adjacent at least one of the edges and corners of the tabular grains.

11. An emulsion according to claim 1 wherein the tabular grains account for greater than 97 percent of total grain projected area.

12. An emulsion according to claim 1 wherein the spectral sensitizing dye exhibits an absorption peak at wavelengths longer than 430 nm.

13. An emulsion according to claim 12 wherein the spectral sensitizing dye is a J-aggregated cyanine dye.

14. A photographic element comprised of a support, a first silver halide emulsion layer coated on the support and sensitized to produce a photographic record when exposed to specular light within the visible wavelength region of from 400 to 700 nm, and a second silver halide emulsion layer capable of producing a second photographic record coated over the first silver halide emulsion layer to receive specular visible light intended for the exposure of the first silver halide emulsion layer, the second silver halide emulsion layer being capable of acting as a transmission medium for the delivery of at least a portion of the visible light intended for the exposure of the first silver halide emulsion layer in the form of specular light, wherein the second silver halide emulsion layer is comprised of an improved emulsion according to any one of claims 1 to 13 inclusive.

* * * * *